US005171402A

United States Patent [19]

Haines et al.

[11] Patent Number: 5,171,402

[45] Date of Patent: Dec. 15, 1992

[54] DISPERSIBLE ARAMID PULP

[75] Inventors: Dina M. Haines, Wilmington, Del.; Thomas F. Schuler, Richmond, Va.

[73] Assignee: E. I. du Pont de Nemours and Company, Wilmington, Del.

[21] Appl. No.: 711,582

[22] Filed: Jun. 6, 1991

Related U.S. Application Data

[62] Division of Ser. No. 506,968, Feb. 28, 1990, Pat. No. 5,084,136.

[51] Int. Cl.[5] ..... D21D 1/34

[52] U.S. Cl. ..... 162/157.3; 162/261; 428/395

[58] Field of Search ..... 162/9, 56, 57, 157.3, 162/261, 28; 264/115, 140; 241/1, 4, 5, 18, 27, 28, 29; 428/395, 369

[56] References Cited

U.S. PATENT DOCUMENTS

| | | | |
|---|---|---|---|
| 3,242,035 | 3/1966 | White | 28/247 |
| 3,610,542 | 10/1971 | Yamagishi | 241/43 |
| 3,627,630 | 12/1971 | Gagnon | 162/100 |
| 3,775,930 | 12/1973 | Mercer et al. | 53/209 |
| 4,347,985 | 9/1982 | Simpson | 241/1 |
| 4,472,241 | 9/1984 | Provost | 162/157.3 |
| 4,483,743 | 11/1984 | Turbak et al. | 162/9 |
| 4,747,550 | 5/1988 | Jackering | 241/55 |
| 4,811,908 | 3/1989 | Galati | 162/9 |
| 4,855,179 | 8/1989 | Bourland et al. | 264/115 |
| 4,919,340 | 4/1990 | Gerber | 241/5 |
| 4,957,794 | 9/1990 | Bair | 428/297 |

FOREIGN PATENT DOCUMENTS 57-36167 2/1982 Japan .

OTHER PUBLICATIONS

Research Disclosure Item 19037, Feb. 1980.
Ultra-Rotor IIIA (Sales Brochure).
Turbo-Mill (Sales Brochure).

*Primary Examiner*—W. Gary Jones
*Assistant Examiner*—Todd J. Burns

[57] ABSTRACT

A process is disclosed for making a compacted, redispersible, aramid pulp fiber product wherein aramid pulp is opened using the forces of a turbulent air grinding mill and then the opened pulp is compacted to the extent desired for shipping.

3 Claims, No Drawings

DISPERSIBLE ARAMID PULP

This is a division of application Ser. No. 07/506,968, filed Feb. 28, 1990, now U.S. Pat. No. 5,084,136.

BACKGROUND OF THE INVENTION

1. Field of the Invention

This invention relates to a process for making a pulp of aramid fibers which is easily dispersible in liquid systems and to the dispersible aramid pulp, itself.

2. Description of the Prior Art

U.S. Pat. No. 3,610,542, issued Oct. 5, 1971 on the application of Yamagishi, discloses a turbulent air pulverizer said to be useful in pulverizing and decomposing various materials. Natural fibrous materials are specifically disclosed.

Japanese Patent Publication (Kokai) 36167-1982 discloses a thixotropy enhancer made by dispersing a polymer solution in an agitated nonsolvent liquid to yield precipitant particles of the polymer, and then washing, drying, and pulverizing the particles to make a material useful in thickening nonaqueous liquids.

Research Disclosure item 19037, February, 1980, at pages 74–75, discloses pulp made by cutting and masticating or abrading fibers of aromatic polyamide. A variety of uses is disclosed and many of the uses require uniform dispersion in a liquid.

SUMMARY OF THE INVENTION

The present invention provides a compacted pulp of aramid fibers individually opened by means of a turbulent air grinding mill and compacted to a density of 0.08 to 0.5 grams per cubic centimeter (g/cc) (5 to 30 pounds per cubic foot). The pulp fibers have a length of about 0.8 to 8 millimiters (1/32 to 5/16 inch), and a specific surface area of about 5 to 10 square meters per gram ($m^2/g$) (2.4 to 4.8 square feet per pound.

A process for making compacted redispersible aramid pulp fibers is also provided by the steps of cutting staple fibers of aramid; refining the cut fibers to yield a pulp; opening the refined fibers using the forces of a turbulent air grinding mill; and compacting the opened fibers to a density of from 0.08 to 0.5 g/cc. The compacted aramid fibers of this invention exhibit dramatically improved dispersibility in liquids compared with compacted aramid pulp fibers which have not been previously opened using a turbulent air grinding mill.

DETAILED DESCRIPTION OF THE INVENTION

Pulp of aramid fibers has found a variety of uses in the fields of composites and reinforced articles. Aramid fibers are well-known to be extremely strong, with high moduli and resistance to the effects of high temperatures. Those qualities of durability which make aramid fibers highly desirable in demanding applications, also, make such fibers difficult to manufacture and process.

A pulp of such fibers can be made only with specialized equipment designed to refine, masticate or abrade a staple of starting materials. Once the pulp is made, it must, generally, be shipped to the site where it will be ultimately used Because the pulp is of very low density, there is good reason to desire a pulp which can be compacted for shipment and then readily dispersed for later use.

This invention provides a process in which pulp of aramid fibers are treated in such a way to yield a pulp which can be compacted and then readily dispersed in a liquid more uniformly than compacted pulp made by prior art processes and treatments. The compacted pulp product of this invention represents a distinct improvement over similar pulp products of the prior art.

The pulp fibers of this invention are made from aramids. The direct product of the invention is a compacted mass of such pulp fibers. By "aramid" is meant a polyamide wherein at least 85% of the amide (—CO—NH—) linkages are attached directly to two aromatic rings. Suitable aramid fibers are described in Man-Made Fibers - Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Staple fibers used to make the pulp of this invention are from about 3 to 13 millimeters ($\frac{1}{8}$ to about $\frac{1}{2}$ inch) long. It has been found that fibers with a length of less than about 3 mm cannot be properly refined and, therefore, do not yield pulp with the desired qualities. As to the upper extreme, it has been found that staple fibers longer than about 13 mm become entangled during processing and do not yield pulp which can be adequately separated or opened for subsequent use. The preferred staple fiber lengths for this invention are from about 5 to about 13 mm because within that range the individual fibers have been found to result in pulp which can be opened most completely.

The diameter of fibers is usually characterized as a linear density termed denier or dtex. The denier of staple fibers eligible for use in this invention is from about 0.8 to 2.5, or, perhaps, slightly higher.

The pulp of this invention is, generally, made from fibers which have been spun using a so-called air gap spinning process. It is possible that fibers made by other means could be used so long as they are tough enough not to break under the forces of refining. For example, aramids could be wet spun as taught in U.S. Pat. No. 3,819,587. Such fibers are advantageously spun with high orientation and crystallization and can be used as-spun. Fibers wet spun from isotropic dopes and optionally drawn to develop orientation and crystallinity, as taught in U.S. Pat. No. 3,673,143, could also be useful. The air gap (dry-jet) spinning is as taught in U.S. Pat. No. 3,767,756. Dry spinning with subsequent drawing to develop orientation and crystallinity, as taught in U.S. Pat. No. 3,094,511, is another useful method for making the feed fibers of this invention.

The aramid fibers are spun as a continuous yarn and the yarn is cut to the desired length for further processing in accordance with this invention. The cut fibers, known as staple, exhibit a specific surface area of about 0.2 $m^2/g$ and a density, in a mass, of about 0.2 to 0.3 g/cc. Pulp is then made from the staple by shattering the staple fibers both transversely and longitudinally. Aramid pulp is preferably made using the pulp refining methods which are used in the paper industry, for example, by means of disc refining. The pulp fibers have a length of 0.8 to 8 mm (1/32 to 5/16 inch), depending on the degree of refinement. and the pulp. Attached to the fibers are fine fibrils which have a diameter as small as 0.1 micron as compared with a diameter of about 12 microns for the main (trunk) part of the fiber.

The pulp is then opened by exposure to a turbulent air grinding mill having a multitude of radially disposed grinding stations including thick blades with essentially flat surfaces spaced further apart than the thickness of the fibers and surrounded by a jacket stator with raised ridges;—the gap between the ridges and the flat surfaces of the blades being about 1.0 to 4.0 mm.

A Model III Ultra-Rotor mill, as sold by Jackering GmbH & Co. KG, of West Germany, is suitable for use in the practice of this invention. This mill contains a plurality of milling sections (that is, blades) mounted on a rotor in a surrounding single cylindrical stator with rilled walls common to all milling sections. The mill has a gravity feed port leading to the bottom section of the rotor. Additionally, three air vents are equally distributed around the bottom of the cylinder surface. An outlet is located on the top of the surrounding stator. A detailed description of a similar mill is in U.S. Pat. No. 4,747.550 issued May 31, 1988.

It is believed that pulp fed through a turbulent air grinding mill is opened more by means of the forces of the turbulent air than by being struck by the blades and the walls of the mill, itself. Reference is made to U.S. Pat. No. 3,610,542.

An important element of this invention and an element which, it is believed, makes the pulp mass of this invention patentable, resides in the fact that the pulp fibers are opened by the turbulent air grinding mill in a way that the individual pulp fibers are no longer attracted to each other to cause them to recombine when pressed together. Although the reasons for the effect are not entirely understood, pulp fibers opened by the action of a turbulent air grinding mill are much more easily dispersible than pulp fibers not opened by such means.

It is, also, important that the pulp fibers, while opened, are not significantly fibrillated. The specific surface area of the opened pulp of this invention is substantially the same as the specific surface area of the unopened pulp starting material. For purposes of comparison, it is noted that the specific surface area of aramid staple is about 0.2 $m^2/g$; the specific surface area of microfibrillar pulp made by refining that aramid staple, is generally greater than 5 and often as much as 10 $m^2/g$; and the specific surface area of that same pulp, in the opened condition of this invention is generally greater that 5 and often as much at 10 $m^2/g$, also.

The pulp of this invention can be treated in any of several ways to achieve special effects. For example, the polymeric material used to make the initial fibers may include additives such as colorants, ultraviolet light absorbers, surfactants, lubricants, and the like. With those additive materials in the polymeric material at the time of the spinning, the additive materials will be included in the pulp of this invention. Additionally, the original fibers, the staple fibers, or the pulp, before or after opening, can be treated on the surface by coatings or other treatments, such as corona discharge or flame exposure. Of course, care must be exercised to avoid any treatment which would adversely affect the fiber-to-fiber relationship of the pulp or the dispersing qualities of the pulp after opening.

As a general rule of performance, before the time of the present invention, pulp was made by refining staple fibers and, then, when the pulp was to be used, it was combined with the liquid into which it was to be dispersed and it was mixed to cause the dispersion. There were several problems with that procedure. First, the dispersion was not as complete or as uniform as was desired; and second, the pulp could not be compacted and shipped in reduced, densified, volumes without substantially increasing the problems associated with dispersibility. As a result of reduced dispersibility, the pulp fibers were more difficult and slower to wet by any liquid dispersing medium. There was some idea that the pulp should be "opened" before use; but even the then-used opening processes (which used rapidly rotating mixer blades or the equivalent) did not complete the opening and even the incomplete opening was not preserved through the compacting processes required for shipment.

The compacted pulp of the present invention yields an almost complete and entirely uniform dispersion; and that dispersion can be obtained even though the pulp has been compacted to a density of more than 0.5 g/cc (30 pounds per cubic foot). The beneficial effects of the opening of this invention can be found in pulp which has been compacted only as much as 0.08 g/cc (5 pounds per cubic foot). On the other hand, in shipping pulp, it is desirable that the pulp be such that it can be compacted as much as possible without affecting the dispersibility of the product. For example, it is expected that pulps of this invention can be compacted to as much as 0.5 g/cc (30 pounds per cubic foot) and still exhibit the excellent dispersibility characterized by this invention.

Pulp is generally used by being dispersed into a polymer matrix with or without additional materials. The pulp serves the purpose of reinforcing the article and the reinforcement is optimized if the pulp is completely dispersed and present uniformly throughout the article. The pulp of this invention can, also, be used as a thixotropic or thickening agent for liquid systems. The pulp of this invention yields articles and systems having improved qualities by virtue of the complete and uniform dispersion.

The pulp of this invention is evaluated by means of dispersibility tests and the test methods for such evaluations are set out below.

Density. For purposes of this invention, the density of a compacted mass of opened pulp is important. The density is determined by weighing a known volume of a pulp mass.

Dispersibility. A "nep" is a tangled mass of fibers. A completely dispersed mass of fibers has no neps and the number of neps increases as the degree of dispersion decreases. Neps can be various sizes. The degree of dispersibility for fibers of this invention is measured by a Nep Test.

The fibers to be tested are pulps which have been opened by the process of this invention or which are to be tested for dispersibility in comparison with the pulp of this invention. The pulp fibers to be tested have been compacted prior to testing.

The compacting is conducted in a controled manner by placing a weighed amount of the pulp into a round metal cylinder. The cylinder is slightly more than 1 inch (2.54 cm) internal diameter and is 8⅞ inches (22.5 cm) deep. A piston of exactly 1 inch (2.54 cm) in diameter and weighing 2.45 pounds (1112 g) fits inside the cylinder. After pouring about 1.5 grams of pulp into the cylinder, the piston is dropped repeatedly a total of twenty times. After the twentieth drop, and with the piston resting on the pulp, the compacted volume can be read (from the portion of the piston which extends above the top of the cylinder) and the bulk density can be calculated. The compacted material is taken from the cylinder and is used to conduct the dispersibility test.

To conduct the test, 24.75 grams of glycerine is poured into a 50ml beaker; and 0.25 gram of the compacted fibers to be tested is added. The pulp fibers are mixed, by hand, into the glycerine for two minutes with a glass rod of 5mm diameter, using a circular motion at about 120 strokes per minute. Fibers are wiped from the beaker sides as stirring proceeds.

At the end of the mixing time, one-half of the dispersion is poured onto the center of a transparent plate and a second transparent plate is placed over the first with adequate pressure to cause the dispersion to spread to a circle about 15 centimeters (6 inches) in diameter The second plate includes a transparent grid marked with four one-inch (2.54-cm) square cells in the center. The neps in each cell are counted and graded, with factors as to size, in the following way:

3 for neps 3.2 to 5.1 mm (large);
2 for neps 1.6 to 3.2 mm (medium);
1 for neps less than 1.6 mm (small).

The entire procedure is repeated with the second half of the dispersion to provide a duplicate reading for that system. When a material exhibits neps greater than about 5.1 mm, it is concluded that the material is unacceptably difficult to disperse and it fails the test.

The "Nep Score" is calculated by totaling a weighted counting of the neps in accordance with their size and population (number of neps times grade number) and dividing by two:

$$\text{Nep Score} = \frac{(\text{lge} \times 3) + (\text{med} \times 2) + (\text{sml} \times 1)}{2}$$

Low Nep Scores are indicative of good dispersibility. The pulp of this invention generally exhibits Nep Scores of less than 100 and usually less than 50.

DESCRIPTION OF THE PREFERRED EMBODIMENTS

In the following examples, aramid pulp, which was made by refining aramid staple fibers of about 1.5 denier and about 1.25 cm length, was opened, compacted in accordance with the present invention, and then tested for dispersibility. Three of the unopened pulps were commercially available under the tradename "Kevlar" sold by E. I. du Pont de Nemours & Co.; and one of the unopened pulps was commercially available under the tradename "Twaron" sold by Akzo N. V. The identity of the pulps is as follows:

TABLE I

| Material | Code | Length Range (mm) | Average Length (mm)* |
|---|---|---|---|
| Kevlar ® | | | |
| "302" | A | 0–5 | 1.78 |
| "305" | B | 0–7 | 3.13 |
| "371" | C | 0–2.75 | 1.03 |
| Twaron ® | D | 0–3.50 | 1.48 |

*The average length is the second moment average as determined using a Fiber Length Analyzer, Model FS-100 sold by Kajaani, Inc., Norcross, GA, USA.

EXAMPLE I

Each of the above-identified pulp materials was tested for dispersibility after being subjected to agitating treatments, including that of the turbulent air grinding mill of this invention and comparison treatments from the prior art. The agitating treatments from the prior art included exposure to the forces of a laboratory blender such as that known as a Waring Blendor; and grinding in a mixer known as an Eirich Mixer. An Eirich Mixer is a heavy-duty mixer with high speed blades in a closed, counter-rotating, vessel with a wall scraping bar resulting in high speed collisions of individual particles. Eirich Mixers are sold by Eirich Machines, Inc., N.Y., N.Y., USA. As a control, each of the pulps was also tested, as received, without the benefit of any agitating forces.

As examples of the invention, the pulps were subjected to the forces of two different turbulent air grinding mills. One of the mills is known as a Turbomill, described in U.S. Pat. No. 3,610,542 and sold by Matsuzaka Co., Ltd., Tokyo. The other mill was an Ultra Rotor, Model III, sold by Jackering GmbH & Co. KG, of West Germany.

Samples of each of the aramid pulps were conducted using each of the agitating or opening devices:

i) For testing the pulp "as received", without opening treatment, the pulp was manually fluffed and placed into the compacting cell.

ii) For the blender, 2 to 5 grams of the pulp were placed in a 1 liter Waring Blendor jar and were agitated at full speed for two one-minute cycles.

iii) For the Eirich Mixer, about 200 grams of the pulp were placed in the vessel and the chopper blades were run at 3225 rpm with the vessel rotating in the opposite direction at 71 rpm for two two-minute cycles.

iv) For the Turbomill, pulp was fed through the mill operated at 4000 rpm with a tip speed of 52.4 meters/-second and a clearance of about 3 millimeters. All vents on the mill were closed and the pulp opening treatment was completed in a single pass.

v) For the Ultra Rotor, pulp was fed through the mill operated at 2150 rpm with a tip speed of 81 meters/-second and a clearance of about 3 millimeters. All vents on the mill were closed and the pulp opening treatment was completed in a single pass.

The resulting products were compacted as has been described in the Dispersibility test method, above. The resulting pulp densities varied slightly from sample to sample but were in the range of 0.10 to 0.13 g/cc (6.5 to 8.3 pounds per cubic foot). Samples of the compacted aramid pulp were tested for dispersibility in accordance with the aforedescribed test. Results are shown in Table II, below.

TABLE II

| Sample | Treatment | Nep Score | Density (#/ft$^3$) |
|---|---|---|---|
| A | As received | 178 | 9.17 |
| A | Eirich | 153 | |
| A | Ultra Rotor | 39 | 7.24 |
| A | Turbomill | 23 | |
| B | As received | 273 | 8.73 |
| B | Eirich | 192 | |
| B | Ultra Rotor | 55 | |
| C | As received | 372 | 8.09 |
| C | Eirich | 442 | 8.60 |
| C | Blendor | 171 | 8.60 |
| C | Turbomill | 3 | 6.71 |
| C | Ultra Rotor | 4 | |

TABLE II-continued

| Sample | Treatment | Nep Score | Density (#/ft$^3$) |
|---|---|---|---|
| D | As received | 20* | 8.35 |
| D | Eirich | 18* | 8.09 |
| D | Blendor | 18* | |
| D | Turbomill | 3 | 7.97 |

*In each of these tests, there were several neps which ranged in size from 0.5 to 1.7 cm. Those samples were, therefore, disqualified.

With only one exception, the Nep Scores for pulps opened by the turbulent air mills were less than 50; and Nep Scores for pulps not treated by turbulent air mills were greater than 150. It is noted that the Nep Score for Material B treated by the Ultra Rotor was greater than 50; but was much less than Nep Scores for pulp not treated in accordance with this invention. It is believed that the slightly higher Nep Score for Material B may be due to the slightly greater fiber length of that material.

EXAMPLE II

To test an extreme case of the benefits of this invention, a special test was conducted in which aramid pulp was compacted to an unusually high density; and that compacted pulp was tested for dispersibility. Samples of the material identified as "A", above, in the form of As Received, Blendor opened, and treated in the Ultra Rotor, were compacted using the same amounts of material and the same piston and cylinder device as described previously except that the actual compacting was done by pressing the piston into the cylinder using an Instron machine exerting about 1000 pounds of force on the piston.

Because the densities were so high, the dispersing forces in the dispersibility test were increased. To conduct the dispersibility test, two grams of each of the compacted pulp samples were added to 198 grams of glycerine and mixed for two 30-second cycles in a Waring Blendor. Results are shown in Table III, below.

TABLE III

| Sample | Treatment | Nep Score | Density (#/ft$^3$) |
|---|---|---|---|
| A | As received | * | 32.7 |
| A | Blendor | * | 33.1 |
| A | Ultra Rotor | 18 | 33.1 |

*Very large neps (from 1.2 to more than 2.5 cm in major dimension) were present in the test grid and Nep Scores could not be determined.

We claim:

1. A compacted redispersible, refined, aramid fiber pulp of opened aramid fibers having a length of 0.8 to 8 millimiters, a specific surface area of 5 to 10 square meters per gram, and a denier of 0.8 to 2.5; wherein said aramid fibers are opened by the forces of a turbulent air grinding mill, and the compacted pulp exhibits a density of 0.008 to 0.5 grams per cubic centimeter.

2. The compacted redispersible, refined, aramid fiber pulp of claim 1 wherein the pulp exhibits a Nep Score of less than 100.

3. The compacted redispersible, refined, aramid fiber pulp of claim 1 wherein the pulp exhibits a Nep Score of less than 50.

* * * * *

UNITED STATES PATENT AND TRADEMARK OFFICE

CERTIFICATE OF CORRECTION

PATENT NO. : 5,171,402

DATED : DECEMBER 15, 1992

INVENTOR(S) : DINA M. HAINES AND THOMAS F. SCHULER

It is certified that error appears in the above—identified patent and that said Letters Patent is hereby corrected as shown below:

COL. 8, CLAIM 1, LINE 25, INSERT "0.08" IN PLACE OF -- 0.008 --.

Signed and Sealed this

Nineteenth Day of October, 1993

*Attest:*

*Attesting Officer*

Bruce Lehman

BRUCE LEHMAN

*Commissioner of Patents and Trademarks*